US007557720B2

(12) United States Patent
Rubin et al.

(10) Patent No.: US 7,557,720 B2
(45) Date of Patent: Jul. 7, 2009

(54) PERSONAL EMERGENCY DEVICE

(75) Inventors: Bennett S. Rubin, Pepper Pike, OH (US); Richard C. Adamany, Chagrin Falls, OH (US)

(73) Assignee: Crestwood Partners, LLC, Mayfield Village, OH (US)

( * ) Notice: Subject to any disclaimer, the term of this patent is extended or adjusted under 35 U.S.C. 154(b) by 295 days.

(21) Appl. No.: 11/594,960

(22) Filed: Nov. 9, 2006

(65) Prior Publication Data

US 2007/0182572 A1 Aug. 9, 2007

Related U.S. Application Data

(60) Provisional application No. 60/763,382, filed on Jan. 31, 2006.

(51) Int. Cl.
*G08B 13/00* (2006.01)

(52) U.S. Cl. ..... 340/574; 340/321; 340/331; 340/468; 340/815.4; 340/815.45; 362/197; 362/198; 362/205; 362/208

(58) Field of Classification Search ..... 340/574, 340/468, 331, 321, 815.4, 815.45; 362/197, 362/198, 199, 202, 205, 208, 157; 361/93.1
See application file for complete search history.

(56) References Cited

U.S. PATENT DOCUMENTS

| | | | | |
|---|---|---|---|---|
| 4,209,870 | A * | 7/1980 | Doyel | 15/97.1 |
| 4,290,095 | A * | 9/1981 | Schmidt | 362/191 |
| 5,657,543 | A * | 8/1997 | Collins | 30/367 |
| 5,952,916 | A * | 9/1999 | Yamabe | 340/468 |
| 6,418,628 | B1 | 7/2002 | Steingass | |
| 7,033,042 | B2 * | 4/2006 | Lim | 362/202 |
| 7,188,969 | B2 * | 3/2007 | Uke et al. | 362/208 |

* cited by examiner

*Primary Examiner*—Hung T. Nguyen
(74) *Attorney, Agent, or Firm*—Smith, Gambrell & Russell, LLP

(57) ABSTRACT

The invention relates to a portable, personal alarm device. The device features a housing comfortably held within one hand of its user. The device provides emergency tools, particularly in the event of an automotive emergency such as a vehicle accident. These features include a mechanism to cut through the web material of vehicle's seatbelts, and a mechanism to break the vehicle's windows. Both such features providing emergency means of escape for the vehicle's occupants. The inventive device further includes electronic circuits providing a flashlight function, and an emergency flasher, and also an audible alarm function. The device is water resistant and also may be provided from materials which make it visible in the dark, prior to activation of any of its functions. The inventive device also serves the routine function of a key ring so that it will always be available to the user in the event of an automotive emergency.

17 Claims, 5 Drawing Sheets

PERSONAL EMERGENCY DEVICE

This application claims priority from provisional application No. 60/763,382 filed Jan. 31, 2006 and incorporates such provisional application in its entirety herein.

FIELD OF THE INVENTION

The present invention relates generally to micro tools. More specifically, the present invention relates to a micro scale multifunction device for use in emergencies. It has particular application in automotive emergency situations.

BACKGROUND OF THE INVENTION

A need has remained unfulfilled in the prior art for a compact, portable, personal emergency tool or device, particularly one with features for use in an emergency situation created by an automobile accident. A severe automobile accident can create the need for an emergency escape from the disabled vehicle. To ensure capability for an emergency escape, there is need for a way to sever the automobile's seatbelts in the event that the seatbelt mechanism is jammed or otherwise will not release one or more of the passengers. In the event of disabling damage to the door and/or lock mechanism, or submersion in water, there is need for a way to break the vehicle's windows to provide means of escape therethrough. It also is recognized that automobile accidents frequently occur in the evening or at night, and that therefore the accident victims maybe left without light. This creates the need for an emergency device that glows in the dark, that provides at least a flashlight function, and that also provides a way of signaling others to call attention to the fact that an emergency situation exists.

The prior art is seen as lacking a compact, hand held device or tool that satisfies these emergency escape and signaling requirements. Hence, a need has remained for a personal device that would provide these functions and would be accessible immediately in an emergency situation.

SUMMARY OF THE INVENTION

The present invention is an advancement over the prior art in providing a portable, personal emergency device that will be on one's person and readily available in an emergency situation. The personal emergency device or tool is contemplated as serving as a key ring so that the device will always be at hand such as in a person's pocket or purse. Overall size is an important consideration for the present invention. It fits easily into the palm of the user's hand, with the user's keys depending therefrom.

The present invention has a housing that contains and protects several internal elements providing various emergency functions, and an external ring anchored to the housing to secure the user's keys. Preferably, the internal elements include a cutting blade that normally is covered by a friction fitting blade cover. When exposed, the blade provides a means for cutting through an automotive vehicle's seatbelt webbing in the event that the driver or passengers are incapable of unfastening the seatbelts. The housing of the invention is configured to have a main portion and a projecting portion which define a recess for receiving the seatbelt web material and guiding it to the blade for cutting.

Another emergency feature of the present invention is an internal mechanism providing capability to break tempered, unlaminated automobile side window glass. This mechanism relies upon a spring actuated pin with a sharp point that is driven into the glass to break it. This mechanism easily is operable, requiring only pushing force applied to the invention when it is placed in contact with the window glass. When sufficient force is applied, the contact pin is released and automatically driven into the glass. Releasing the pushing force automatically resets the pin for further use. This mechanism provides a means of escape through the windows in the event that vehicle doors are unpassable.

The present invention also includes electronics. This, of course, places requirements on housing that it be resistant to water and other fluids to prevent fluid contact with the electronics. Again, with the view to limiting the size of the device, all of the electronics are operated from the same power source, a single battery. The electronics provide a usual white-light flashlight function. They further provide an emergency flasher to alert of an emergency situation. Preferably, the flashlight and flasher functions are satisfied by white-light and red-light LEDs. The electronics controls two red LEDs to flash on and off in opposite sequences so that one is flashing ON while the other is flashing OFF. Further, the electronics provide an audible alarm means such as a high frequency piezoelectric speaker. Push buttons on the housing provide fingertip control of all electrical functions for the user. In addition to the lighting functions, the housing itself may be made visible by the fabrication of one or more portions of the housing from a photoluminescent material. In this way the device will be visible to the user in the dark, even before any function of the device is activated.

BRIEF DESCRIPTION OF THE DRAWINGS

FIG. 3(*b*) also is a cut-away plan view showing the device of FIG. 1 when the window glass breaking mechanism is deployed;

DETAILED DESCRIPTION OF THE PREFERRED EMBODIMENTS

Figure 1:
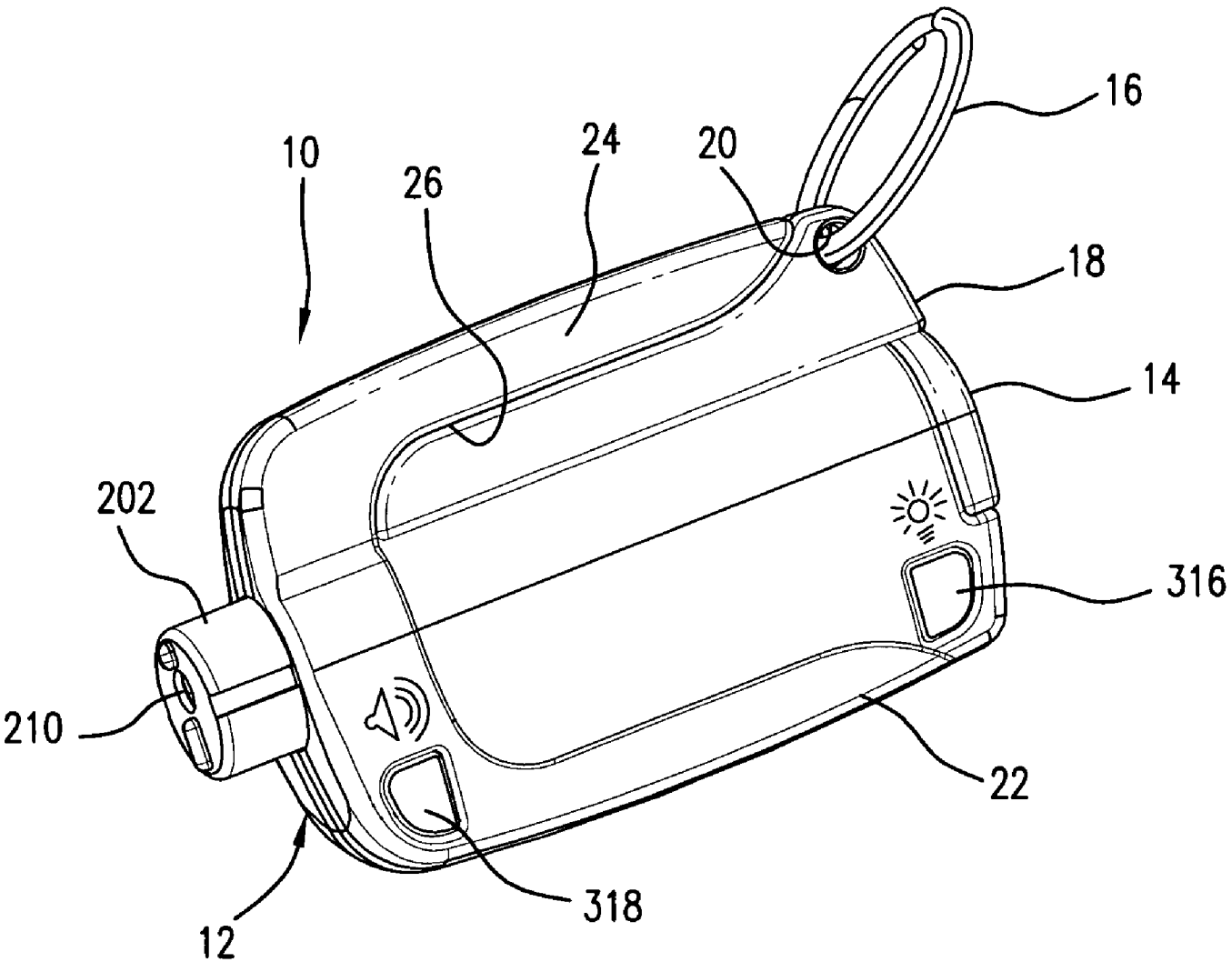
FIG. 1 is a perspective view of a preferred embodiment of the personal emergency device in accordance with the present invention.

FIG. 1 is a perspective view of a portable, personal emergency device 10 in accordance with the present invention. Emergency device 10 is a hand-operated instrument. Its actual size is contemplated such that it will fit easily into one hand of the user. Depending upon the features provided with device 10, the overall size of a commercial embodiment thereof is expected to measure on the order of 3 inches by 1.5 inches by 0.7 inches. As apparent from FIG. 1, device 10 provides the general function of a key ring as evident from ring 16 anchored at an end portion of the emergency device.

Figure 2:
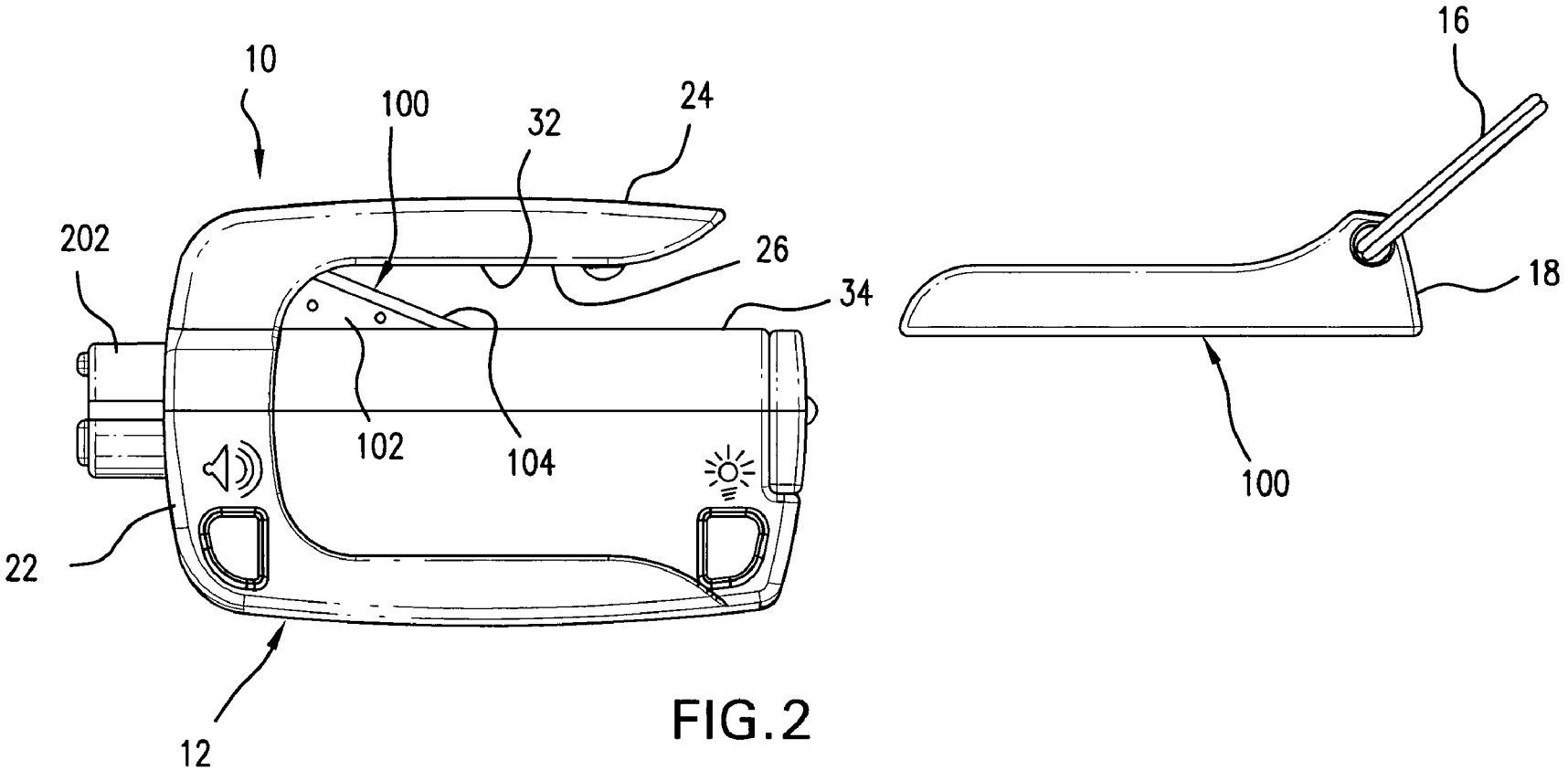
FIG. 2 is a plan view of the device of FIG. 1, also showing the blade cover removed from the housing of the device.
Figure 3A:
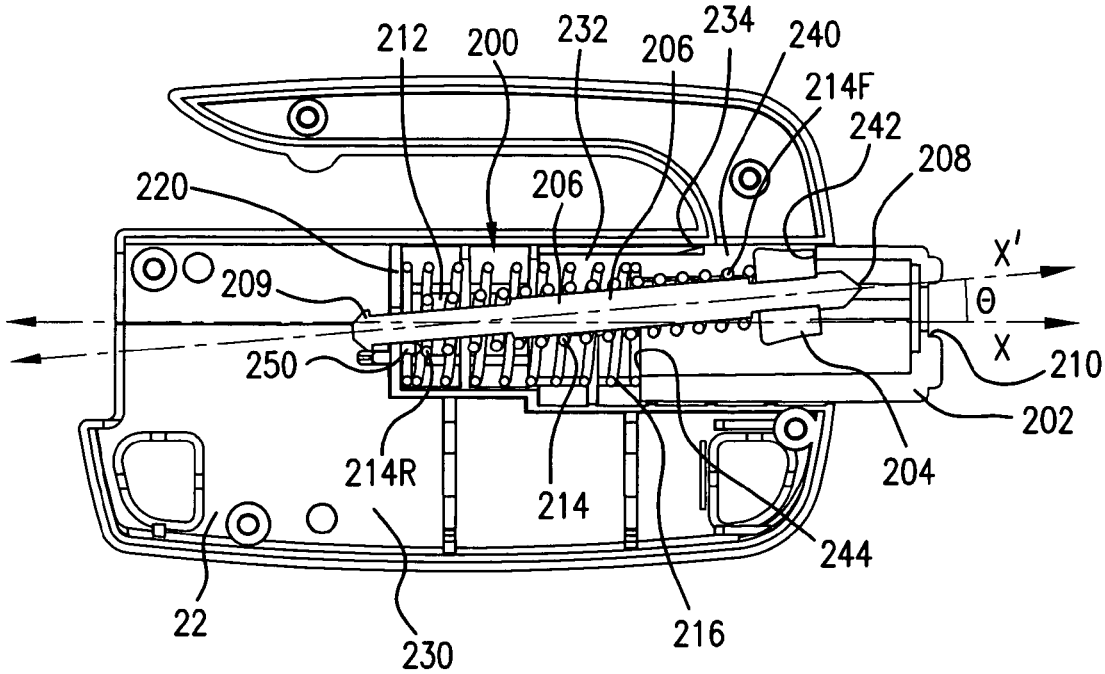
FIG. 3(*a*) is a cut-away plan view showing the arrangement of internal elements of the device of FIG. 1 when the device is in a state ready for use.
Figure 3B:
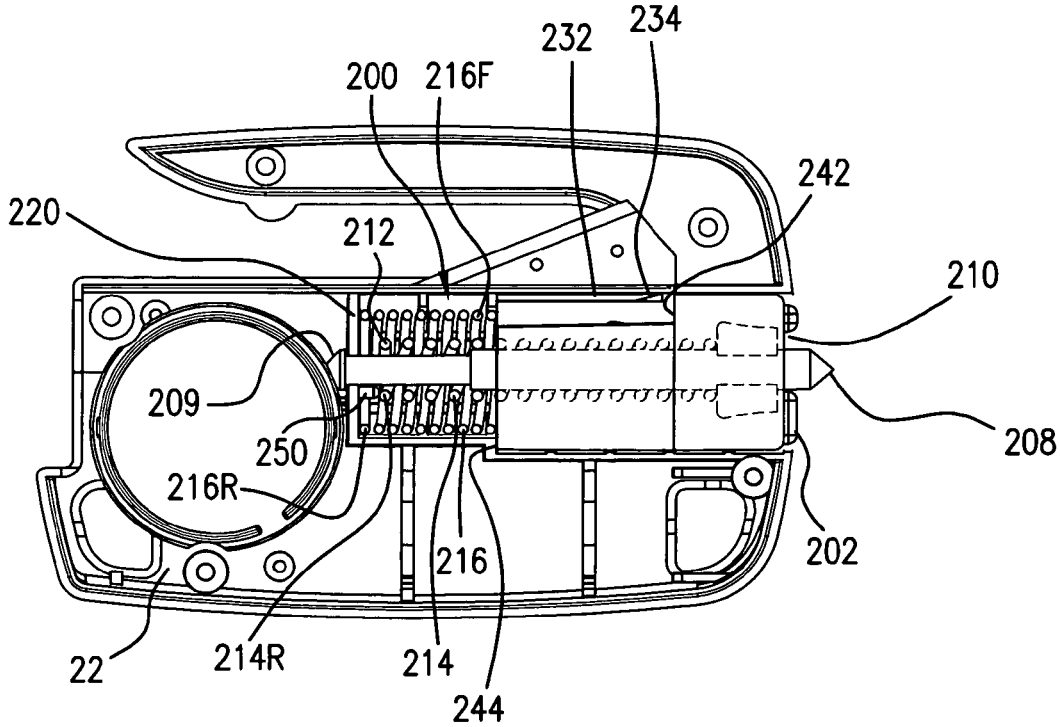
Figure 4:
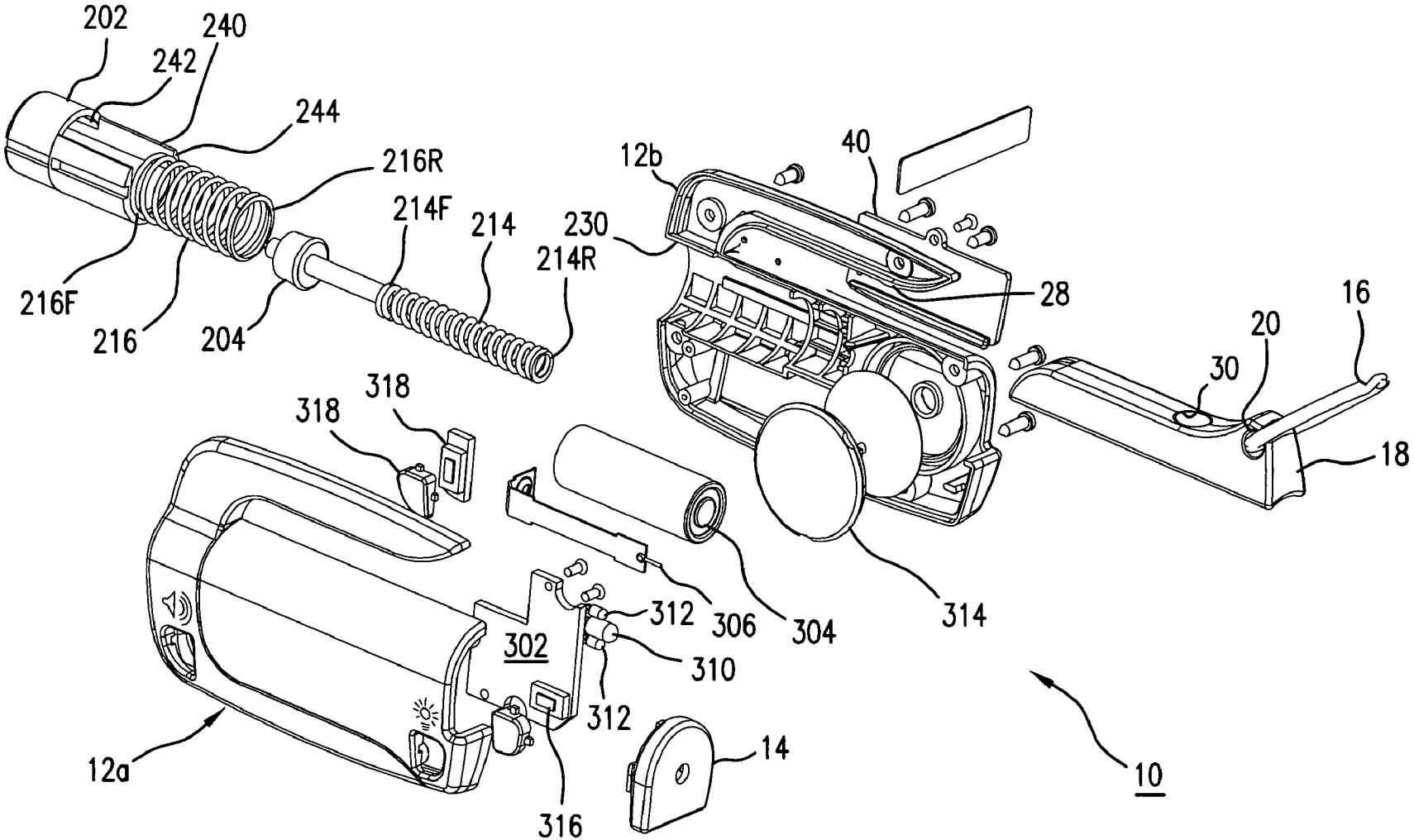
FIG. 4 is an exploded view of the device of FIG. 1.

Reference now is made to FIGS. 2 through 4 to discuss the several functions of emergency device 10, and details of its internal construction. Emergency device 10 incorporates a housing 12 that preferably, is manufactured inexpensively by injection molding. In the exemplary, preferred embodiments shown, housing 12 basically has two parts, a front housing member 12*a* and a rear housing member 12*b*. A translucent dome member 14 is mountable to one end of housing 12.

Previously mentioned above, the (key) ring 16 is provided to device 10 by way of a blade cover 18 with its through-hole 20. In FIG. 2, blade cover 18 is depicted as withdrawn from housing 12. Housing 12 is completed by an externally protruding guide piece 202. Preferably, guide piece 202 also is manufactured by injection molding. Its purpose will be discussed in detail below. Housing 12 should be splash resistant to seal and protect internal elements. It particularly is important to eliminate access to circuit electronics by fluids. For a commercial embodiment, it is not considered necessary but, if desired, device 10 could be made completely waterproof.

In addition to its two halves 12*a* and 12*b*, housing 12 also comprises what will be referred to as its main portion 22 and an upper, projecting portion 24. Preferably, projecting portion 24 integrally is formed with the main portion 22 of housing 12. So formed, projecting portion 24 and main portion 22 define a recess 26 therebetween. As appreciated from the figures, perhaps best from FIG. 2, recess 26 receives blade cover 18 therewithin. In the preferred embodiments, blade cover 18 secures within recess 26 by a friction fit. As is apparent to those of ordinary skill in the art, such a friction fit can be provided by a combination of detents and corresponding indents provided with these plastic components. Such a detent 28 and corresponding indent 30 are shown in FIG. 4. As also will be appreciated, the friction fit is sufficient to maintain blade cover 18 inserted into recess 26 in normal situations, but to permit the easy removal of blade cover 18 (FIG. 2) by pulling on key ring 16 (and/or any keys held by ring 16), in order to free blade cover 18 from the remainder of emergency device 10.

Blade cover 18 is an element of a cutting mechanism 100 feature of emergency device 10. Where device 10 is contemplated as personal emergency equipment in connection with an automobile, cutting mechanism 100 is contemplated as providing capability to cut through automotive seatbelts in order to quickly free the occupants. To this end, cutting mechanism 100 includes cutting blade 102 mounted within the main portion 22 of housing 12 so as to project into and occupy a section of recess 26. Blade 102 may be a razor type crafting blade. In manufacturing housing 12, blade 102 is contemplated as insert-molded to ensure a proper and secure fit. Where blade 102 is insert molded, it will have little chance of dislodging or rattling. Projecting portion 24, and specifically its lower guide wall 32, together with upper guide wall 34 of housing main portion 22 guide the seatbelt to the inclined edge 104 of blade 102 to effect cutting. Blade 102 cuts the webbing material of an automotive seatbelt as the seatbelt material is received within a cutting wedge area defined by guide walls 32, 34, and blade edge 104.

The purpose of blade cover 18 now is clear. Cover 18 is received within recess 26 in order to protect against accidental injury by blade 102. However, as appreciated, in emergency circumstances, cover 18 must be pulled away from housing 12 to expose blade 102. This is the reason for the frictional fit of blade cover 18 within housing 12. In the preferred embodiments, blade cover 18 is an injection molded member formed of a photoluminescent material so that it will be visible in the dark, should the need arise to disengage the cover from housing 12 and thereby unsheathe or expose blade 102 for use. Indeed, this "glow in the dark" property of blade cover 18 makes emergency device 10 itself visible in dark conditions. Hence, at least blade cover 18 is recommended as molded to include photoluminescent material.

A further emergency feature of device 10 is provided by a glass breaking mechanism referred to generally as mechanism 200. Mechanism 200 includes the guide piece 202, previously mentioned, as an externally visible element with housing 12. Guide piece 202 serves as a guide for an assembly that is designed to break the glass of an automobile window, preferably a side window, in an emergency situation. Guide 202 itself is fashioned to be retractable within housing main portion 22. By alternately retracting into or extending from housing 12, piece 202 regulates movement of a pin guide 204 and a contact pin 206. Pin guide 204 may be a separate component fixed to pin 206 as shown. Alternatively, pin 206 and pin guide 204 can be a unitary element. Pin 206 has a pointed end 208 that is driven into window glass, and a bulb end 209 that ultimately restrains the pin from separating from device 10.

With particular reference now to FIG. 3(*a*), pin 206 is shown in its loaded state, ready for deployment. Pin 206 is disposed to form an angle θ of about 5° with respect to the horizontal axis, X, through a cavity 230 defined by housing halves 12*a* and 12*b*. A compression spring arrangement 212 coaxially surrounds pin 206 in cavity 230 and provides both the driving force for pin 206 and means for resetting the glass breaking mechanism 200. When pin 206 is loaded, the rear end 214R of its force spring 214 contacts a horizontal rib 250 at only a lower portion. Contact with rib 250 causes pin 206 and force spring 214 to pivot and reorient from horizontal axis X to along the inclined axis X' as shown. In this orientation, the force spring's forward portion 214F urges against pin guide 204. In the preferred embodiment, spring forward portion 214F is anchored in pin guide 204. Pin 206 and force spring 214 also must be free to pivot back from inclined axis X' to horizontal axis X within cavity 230, and within a reset spring 216 of spring arrangement 212. No such pivotable motion is necessary for reset spring 216.

In the preferred embodiment, pin 206 and force spring 214 are maintained in their X'-axis orientation by guide piece 202. Guide piece 202 generally is tubular (cylindrical in the preferred embodiment) with an upper open section 240 providing a first arcuate wall section 242 facing pin guide 204. Wall section 242 acts as a stop for pin guide 204 when the pin guide abutts against the wall section as shown in FIG. 3(*a*). To release pin guide 204 and pin 206 for deployment, cavity 230 has an upper wall 232 with a downwardly facing disengagement ramp 234. As breaking mechanism 200 is operated by pressing guide piece 202 against glass, piece 202 retracts to within housing 12 and thereby, by means of arcuate wall section 242, moves pin guide 204 rewardly into contact with ramp 234. Ramp 234 acts to move guide 204 downwardly in order to align pin 206 with an opening 210 in guide piece 202. As soon as pin 206 comes into alignment with opening 210, force spring 214 becomes free to urge pin out of opening 210 and into the window glass. Pin 206 ejects forwardly until bulb end 209 reaches wall section 220, to prevent the pin from actually leaving the emergency device. The deployed state of mechanism 200 is shown in FIG. 3(*b*). In the deployed state, force spring 214 is fully extended, while reset spring 216 is fully compressed.

Once hand pressure on device 10 and specifically, on guide piece 202 is released, reset spring 216 automatically relaxes and urges guide piece 202 to return to its unretracted, forward, ready position. Rear end 216R of reset spring 216 is anchored in cavity 230 and its forward end 216F merely presses against a second rear wall section 244 of guide piece 202. In the preferred embodiment, reset spring 216 does not extend into the guide piece or even need to be affixed thereto. As reset spring urges guide piece out to its forward position, contact between force spring 214 and horizontal rib 250 automatically orients pin 206 upwardly to the X'-axis whereupon pin guide 204 reengages arcuate wall section 242 to reset mechanism 200 for further use. As now is apparent, mechanism can be so operated and reset very quickly, as many times as necessary to knock out a vehicle window. As also now is apparent, those of ordinary skill in the art can substitute other mechanical driving and resetting arrangements for pin 206 within preferred glass breaking mechanism 200. At the risk of complicating preferred emergency device 10, electromechanical assemblies likewise could be used to provide the force to break window glass, as now likewise understood by those of ordinary skill.

Electronics 300 provides still further functions for preferred emergency device 10. Specifically, in the preferred embodiments, device 10 has a flashlight function and also an emergency flasher function. The heart of electronics 300 is provided by a circuit board 302 which receives electrical power from battery 304 encased and held within the main portion 22 of housing 12. Contacts 306 engage the terminals of battery 304 and provide electrical power to circuit board 302. Mounted to circuit board 302 are three LEDs operating in the visible spectrum. A first LED 310 emits high intensity white light to provide the flashlight function. Two further LEDs 312 emit red light to indicate an emergency situation. Preferrably, LEDs 312 are made to activate intermittently, with one LED 312 going ON while the other turns OFF. In addition to emergency lights, electronics 300 includes an audible alarm means in the form of a piezoelectric speaker 314. Electronics 300 is operated manually by push button switches 316 controlling the LEDs, and 318 controlling the piezoelectric speaker 314.

Figure 5:
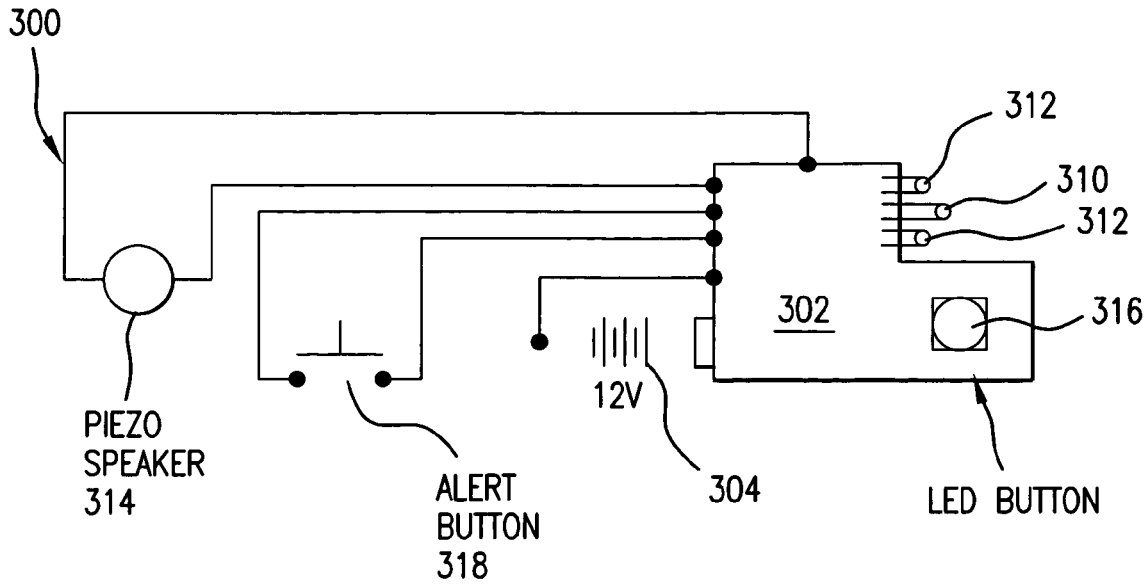
FIG. 5 is a schematic diagram of electronics suitable for use in the device of FIG. 1.

Reference now also will be made to the circuit diagram of FIG. 5. FIG. 5 schematically shows circuit board 302 in connection with battery 304. LEDs 310 and 312 are connected in a series circuit operational by push button 316. As mentioned earlier, dome 14 is constructed of translucent or transparent material; this is in order that dome 14 will pass light therethrough from LEDs 310 and 312. Piezoelectric speaker 314 is in a parallel circuit with the LED circuit, and is controlled by alert button 318 as shown. In the preferred electronic circuit arrangement 300, piezoelectric alarm speaker 314 has a high-pitch, oscillating sound at approximately 120 to 140 db. Also in such preferred arrangement, the emergency alert alarm will continue until the alarm button 318 is depressed for three consecutive seconds. Further, in the preferred circuit arrangement, both the flashlight feature and the visual alarm will be activated by the same push button 316. Specifically, preferred visual operation occurs in a three step process. A first depression of push button 316 activates the flashlight feature. The flashlight remains on until button 316 again is depressed. The second button press will turn OFF LED 310 extinguishing the flashlight, and will turn ON LEDs 312 activating the red flasher feature. LEDs 312 alternate ON and OFF rapidly in sequence, with the sequence of each being opposite to the other. A single 12 volt battery cell 304 supplies power for all of these electronic functions, the flashlight, the emergency flasher, and the audible alarm. The flashing alarm remains activated until button 316 is depressed a third time.

Battery 304 is replaceable. Access to battery 304 is provided by way of a door 40 in the rear housing member 12*b*.

It is understood that there can be various changes and modifications to the preferred embodiments of the present invention disclosed herein. However, all such changes and/or modifications which may be made by one of ordinary skill in the art, still would result in an apparatus well within the scope of the invention as set forth in the claims.

What is claimed is:

1. A portable emergency device comprising:

a housing comprising a main portion, an upper projecting portion connected to said main portion so as to define a recess between said main and upper portions, and a blade cover receivable within said recess;

a glass break mechanism disposed in said housing;

a cutting mechanism within said housing, the cutting mechanism comprising a blade mounted in said housing, said blade being mounted in said main portion of said housing so as to occupy a section of said recess, said blade cover sheathing said blade when said blade cover is received within said slot; and an electric circuit disposed with said housing.

2. A portable personal emergency device as claimed in claim 1, wherein said glass break mechanism includes a contact pin drivable from within said housing to contact glass with a breaking force.

3. A portable personal emergency device as claimed in claim 2, wherein said glass break mechanism includes a spring means for generating said breaking force.

4. A portable personal emergency device as claimed in claim 3, wherein said spring means includes a force spring and a reset spring, and wherein said glass break mechanism further comprises a pin guide fixed to said contact pin and a guide piece for guiding said pin, and wherein said force spring drives said pin in a direction outwardly from said housing.

5. A portable personal emergency device as claimed in claim 4, wherein said guide piece substantially is tubular with an open upper section defining a wall section facing said pin guide, and wherein said force spring urges said pin guide into abutment with said wall section of said guide piece to place said pin in a loaded state, ready for use.

6. A portable personal emergency device as claimed in claim 5, wherein said force spring contacts a horizontal rib in said housing, said rib causing said force spring to orient itself and said pin along an inclined axis that makes an angle with respect to a horizontal axis through a cavity in said housing, said cavity containing said reset spring, said force spring, said pin and said pin guide.

7. A portable personal emergency device as claimed in claim 6, wherein said reset spring coaxially surrounds said force spring, and said pin, wherein said reset spring abuts against said guide piece, and wherein said force spring and said pin pivot about 5° between said inclined axis and said horizontal axis within said reset spring.

8. A portable personal emergency device as claimed in claim 7, wherein said guide piece has an opening, and wherein said cavity has an inner wall with a disengagement ramp for aligning said pin with said opening of said guide piece whereupon said force spring drives said pin into window glass with said breaking force.

9. A portable personal emergency device as claimed in claim 1, wherein said blade cover includes a key ring.

10. A portable personal emergency device as claimed in claim 9, wherein said blade cover comprises photoluminescent material.

11. A portable personal emergency device as claimed in claim 1, wherein said electric circuit comprises a visible light source for selectively providing constant light output to provide a flashlight function, and intermittent light output to provide an emergency alarm function.

12. A portable personal emergency device as claimed in claim 11, wherein said electric circuit further comprises a circuit board, contacts for providing electrical power from a battery to said circuit board, first and second manually operable switches disposed at surfaces of said housing for controlling circuits on said circuit board, and an audible alarm connected to the circuit board.

13. A portable personal emergency device as claimed in claim 11, wherein said visible light source comprises at least one LED that emits white light and at least one LED that emits red light, and wherein said audible alarm comprises a piezoelectric speaker.

14. A portable personal emergency device as claimed in claim 13, wherein said housing includes a translucent dome covering said LEDs.

15. A portable personal emergency device as claimed in claim 13, wherein said visible light source comprises first and second LED's that emit red light intermittently, one LED emitting red light being on while the other is off.

16. A portable personal emergency device comprising:

a housing comprising a main portion and an upper projecting portion connected to said main portion so as to define a recess between said main and upper projecting portions;

a glass break mechanism disposed in said housing;

a cutting mechanism within said housing, said cutting mechanism comprising a blade occupying a section of said recess and having a blade cover removably disposed in said recess to sheath said blade; and an electric circuit comprising a circuit board disposed within said main portion of said housing for mounting thereon a push button switch and a visible light source, the push button switch for operating said visible light source comprising a first LED emitting white light and second and third LED's emitting red light intermittently, one LED emitting red light being on while the other is off.

17. A method of operating an audible alarm and a light source comprising a white LED for a flashlight and a plurality of red LED's for a visible warning, the method comprising:

timing the actuation of an audible alert button for a period of three seconds before deactivating the audible alarm and counting the actuations of a light button whereby a first actuation of said button activates the white LED as a flashlight, a second actuation turns off the white LED flashlight and turns on the plurality of red LED's providing intermittent operation such that one LED emitting red light is on while another is off, and a third actuation results in turning off all LED's.

* * * * *